United States Patent [19]

Lee

[11] Patent Number: 4,796,321

[45] Date of Patent: Jan. 10, 1989

[54] PORTABLE ELECTRICAL BRUSH

[76] Inventor: Fu-Kuei Lee, P.O. Box 10780, Taipei, Taiwan

[21] Appl. No.: 764,628

[22] Filed: Aug. 12, 1985

[51] Int. Cl.[4] ..... A46B 13/04

[52] U.S. Cl. ..... 15/29

[58] Field of Search ..... 15/23, 24, 28, 29, 97 R

[56] References Cited

U.S. PATENT DOCUMENTS

| | | | |
|---|---|---|---|
| 1,625,792 | 4/1927 | Carrington | 15/29 |
| 2,651,795 | 9/1953 | Kilgore | 15/29 |
| 2,744,271 | 5/1956 | Florence | 15/29 |
| 4,168,560 | 9/1979 | Doyel | 15/29 |

FOREIGN PATENT DOCUMENTS

| | | | |
|---|---|---|---|
| 1405404 | 5/1965 | France | 15/24 |

*Primary Examiner*—Edward L. Roberts

[57] ABSTRACT

A portable electrical brush having a water supply and a liquid additive container having a valve controlled outlet is installed on the casing of the brush assembly. The attachment is provided with a water pipe having a valve and an outlet device, which is connected between a hollow shaft and the water outlet of the brush assembly. A motor, a gear reduction set, and a shaft is mounted the same support plate which is secured to upper and lower casings, and a water pipe is connected between the water inlet at the shaft end and water source valve. The space formed by the upper casing and the lower casing is used for containing the above components. The motor start switch, water source valve, and liquid container valve are installed at the outside of the casing such that they can be operated directly. The brush assembly is located at the outside of the lower casing and is removable from the extended portion of the hollow shaft.

6 Claims, 3 Drawing Sheets

PORTABLE ELECTRICAL BRUSH

BACKGROUND OF THE INVENTION

There are several prior inventions that used electrical motor for brushing equipment. For example, U.S. Pat. Nos. 4,158,146, 4,027,348, 4,005,502, and 4,052,776.

Those configurations of the prior inventions include a hollow casing, a battery power supply system, a drive motor, a motor start switch, a dispersed gear set and shaft, a brush connected at the end of a rotating shaft, and a set of fixed motor, gear set, shaft etc., which are combined at a complicated support bracket.

The disadvantages of the prior inventions include:

1. Increased manufacturing cost due to the complexity of the part assembly and the casing, the cost of mold and parts becomes very high.

2. Increased assembling cost: it is required to keep appropriate position for each component and to assemble the shaft, shaft bearing bracket, and motor precisely. The conventional assembling readily accumulates error and therefore increases the failure percentage and cost for tuning.

3. Increasing maintenance cost: since the procedures of dismantling and reassembling are very complicated, the cost for repair and maintenance increases.

4. Inconvenience for using: whenever you use brush assembly for washing, one hand shall hold brush and the other hand shall hold water pipe and you have to change hands for spraying detergent frequently. The washing work is inconvenient and can not be simplified.

My invention is to design brush such that the above disadvantages are resolved.

SUMMARY OF THE INVENTION

My invention provides the device, which will be described latter, to reduce the cost of fabrication, assembly and maintenance. In addition, my invention can provide water and detergent, whenever it is used for washing, and serves as a polisher for wax finishing window, kitchenware, and car etc..

The device of my invention includes a detachable casing and gasket ring which comprise a hollow chamber, a motor and gear reduction set, a rotating transmission apparatus which is composed of a rotating shaft and a simple support bracket, a brush which can be removed from the end of the hollow shaft, a detergent container and a switch that are installed on the head of the upper casing, and a water pipe associated with a water source switch.

BRIEF DESCRIPTION OF THE DRAWINGS

The drawings attached explain the characteristics of the construction and function of the invention.

FIGS. *7a* and *7b* are sectional views taken along the line 7—7 of

Figure 6:
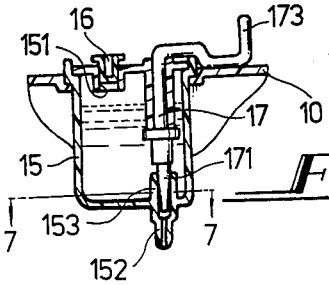
FIG. 6 is the front view of the detergent container which is located at the front portion of the upper casing.

FIG. 6 to show the switch of the detergent container wherein

Figure 1:
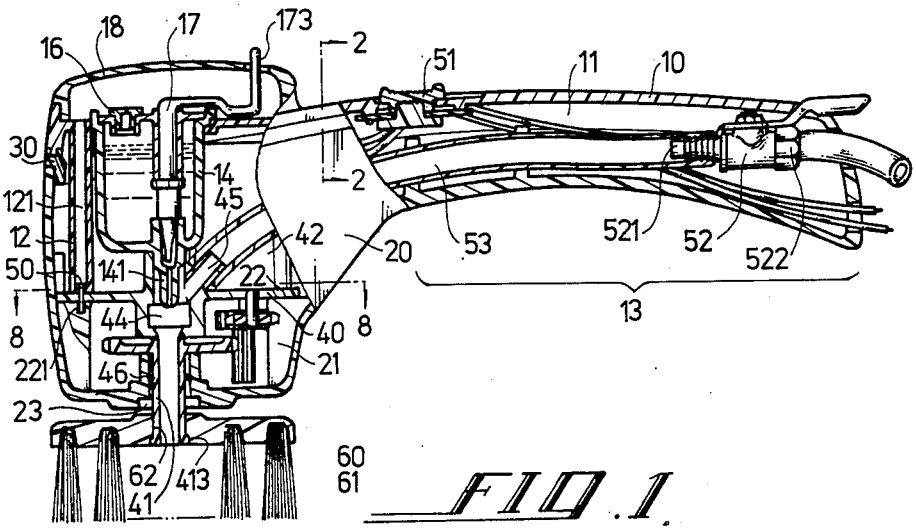
FIG. 1 is a side view and partly sectional view of the invention to show the internal operating elements that include motor, gear set, hollow shaft, detergent and piping etc.
Figure 2:
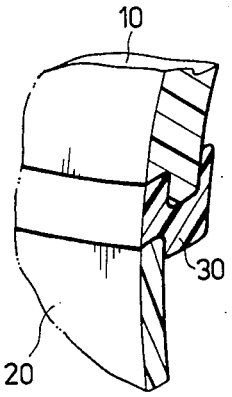
FIG. 2 is a sectional perspective view taken along the line 2—2 of FIG. 1 which has been assembled with the upper casing, the lower casing, and seal gasket.
Figure 9:
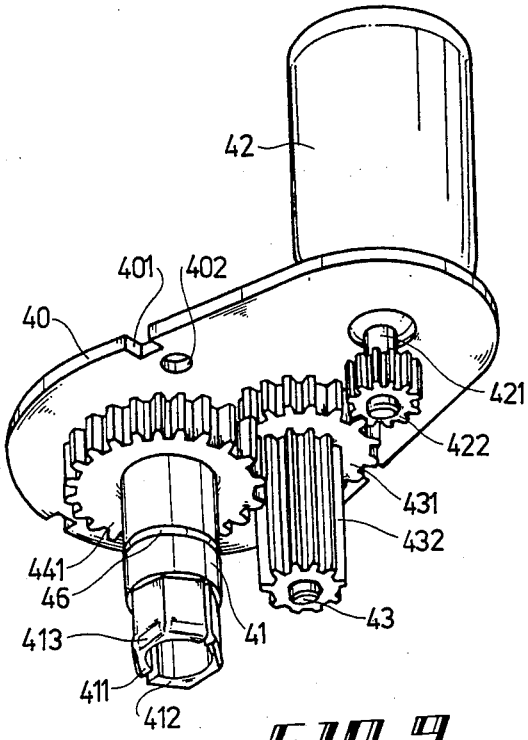
Figure 10:
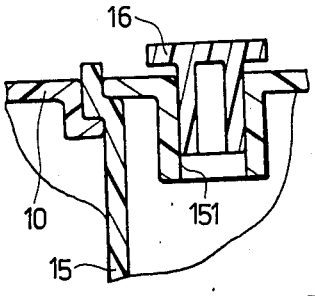
Figure 8:
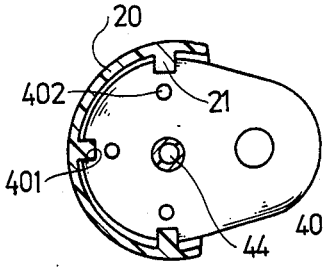
Figure 5:
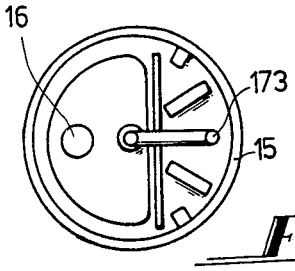
FIG. 5 is the top view of the detergent container which is located at the front portion of the upper casing.
Figure 7A:
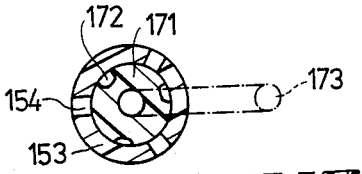
Figure 7B:
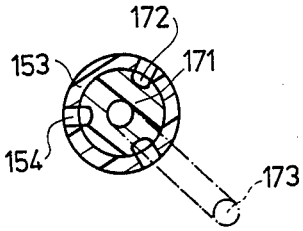

FIG. 7A is closed, and FIG. 7B is open;

FIG. 8 is the sectional view taken along the line 8—8 of FIG. 1 to show the lower casing and support plate;

FIG. 9 is the bottom view of motor speed reduction mechanism of this invention; and FIG. 10 is an enlarged view of the local portion of FIG. 1 to show the device for connecting the lower casing and support plate.

DETAIL DESCRIPTION OF THE PREFERRED EMBODIMENTS

Referring now to the drawings for a more detailed description of the present invention, the device consists of an upper casing 10 and lower casing 20 which form a closed internal compartment 11 associated with sealing gasket 30.

The internal rim of the lower casing 20 has rib 21 composed of at least two ribs, and a shoulder 22 is provided for each rib 21 at the same elevation. There are at least two openings 401 which are located at the corresponding position on the external circle of the support plate 40 of the shaft 41. Therefore, the openings 401 of support plate 40 can be adapted with ribs 21 in an orbital shape arrangement on the shoulders 22, and thereby prevented from rotating.

There are holes 402 at the vicinities of the opening 401 on the support plate 40; the rib of lower casing 20 is provided with threaded holes 221 in alignment with holes 402; there are screw head holes 121 of the same size within the extended rod 12 of the upper casing 10; the distance between the bottom of extended rod 12 and top of shoulder 22 on lower casing 20 is slightly greater than the thickness of support plate 40 as the upper casing 10 and the lower casing 20 are combined. The support plate 40 can be fixed when screw 50 are inserted through holes 402 of the support plate 40 from screw head holes 121 on upper casing 10 and match locked with threaded holes 221 on the lower casing 20.

Figure 3:
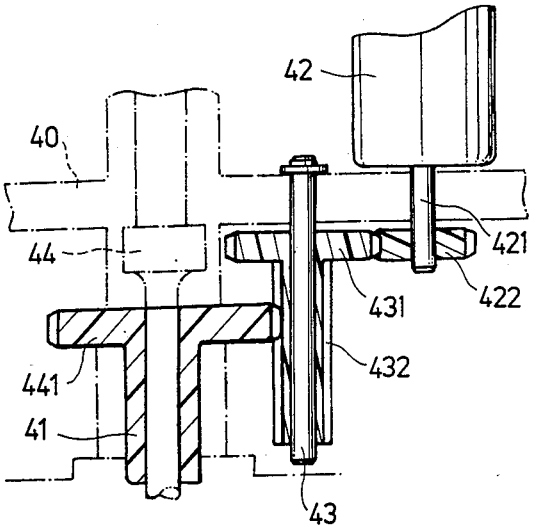
FIG. 3 is the front view of motor, gear reduction set, and hollow shaft.

Motor 42 is mounted on the upper side of support plate 40, as shown on FIG. 3, the motor axle 421 is parallel to inert gear axle 43 and also parallel to hollow shaft 41. Two synchronous rotating gears on the inert axle 43 comprise a first speed reduction gear 431 which is meshed with first driving gear 422 of motor axle 421 and a secondary speed reducing gear 441 mounted on shaft 41 which is meshed with secondary driving gear 432. Inert gear axle 43 is pivoted on support plate 40. Thus, the components from motor 42 to shaft 41 form a single speed reduction driving assembly.

Shaft 41 is pivoted on the hollow water inlet piper 45 which is located at the center of support plate 40. This shaft 41, inert gear 43, and support plate 40 are made of plastic material with low friction coefficient and high abrasive coefficient, and bearing are not required. The external rim of the bottom of shaft 41 is hexagonal and a slot divides the bottom of the shaft to define a pair of cantilever portions 411 and 412 which possess enlarged external rim portions 413. This shaft 41 penetrates through shaft hole 23 of lower casing 20 and mounts a detachable brush 60 whose bottom is fur-like body or equivalent item, and the central hole 62 of the brush 60 bottom is hexagonal whose shape is similar to the shape of cantilevers 411 and 412 of shaft 41 described above. There is an O-ring 46 installed between shaft 41 and shaft hole 23 which can prevent liquid from entering internal compartment 11.

The outer edges 413 of the lower ends of the cantilevers 411 and 412, located at the lower portion of the shaft 41, form a width that is greater than the width of the indentation hole 62. Thus, when the indentation hole 62 of the brush 60 is pushed to the shaft 41, the brush 60 can be fixed at the shaft 41 firmly by means of the tension force produced by the cantilevers 411 and 412. Accordingly, the brush 60 can rotate with the shaft 41 synchronously.

The upper casing 10, described above, is equipped with a handle 13 having a motor start switch 51 at its front end. Besides, there is a fixed water source valve 52 and a joint 521 in front of valve 52, which is used for water pipe 53 to connect water inlet pipe 45 on support plate 40. There is another joint 522 at the back of water source valve 52 to connect a water source.

The front end of upper casing 10 is formed as a groove 14 having an axle hole 141 at bottom; a detachable container 15 of an integrally molded type or slip-on type is mounted in groove 14, and an injection hole 151 is provided in container 15 and closed by plug 16. Container 15 is provided with a circular type outlet 152 at bottom. A flange face 153, forming a tubular shape and with an opening 154, is mounted in the outlet 152. Outlet 152 has a valve stem in it, whose stem rod 171 possesses an equivalent size with outlet 152, and a groove 172 indented toward and parallel to stem axis is at the external circle of stem rod 171. In addition, the top end of valve stem penetrates through container cover 18 to form a handle which can be directly operated at outside of casing. When the groove 172 of valve stem 17 is match faced with the opening 154 of flange face 153, the liquid in container will drip through outlet 153 from groove 172 and will flow into feeding pipe 44 of support plate 40 to meet water inlet pipe 45. When the groove 17 of valve stem 17 and opening 154 are mismatched, container 15 is closed.

Figure 4:
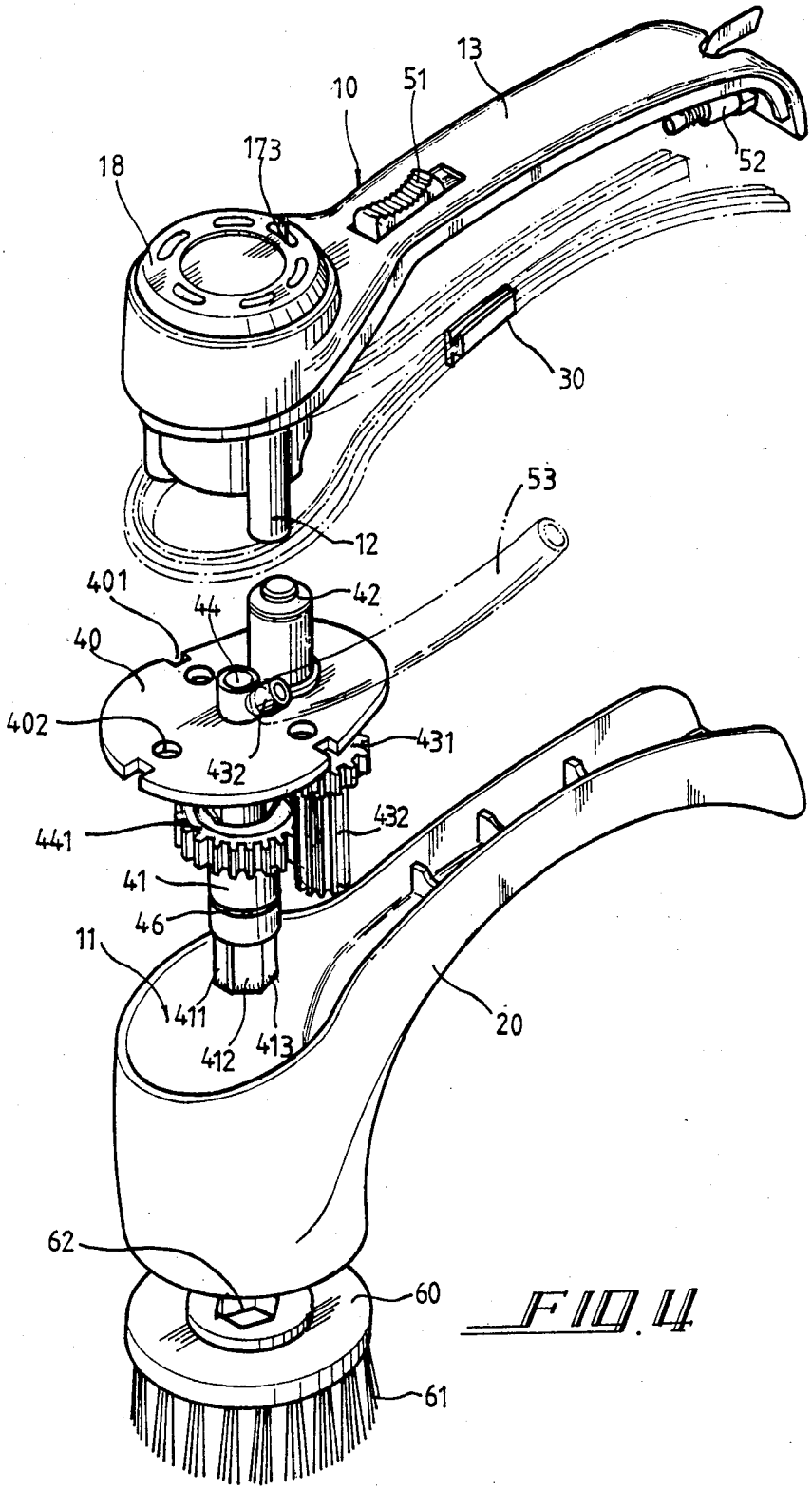
FIG. 4 is a schematic perspective view of the embodiment of the present invention to show the simplication of the structure of the device.

As shown in FIG. 1 and FIG. 4, the assembly is as following: the gear speed reduction set supported by support plate 40 is mounted into shoulder 22 of lower casing 20, water pipe 53 is connected to water source valve 52 and water inlet pipe 45 of support plate 40, a polyamide type sealing ring 30 is mounted at the upper peripheral edge portion 24 of lower casing 20, upper casing 10 is mounted on sealing ring 30 and upper casing 10, support plate 40, and lower casing 20 are locked by the use of screw 50, finally a cover 18 of container 15 and valve stem 17, etc. are mounted in groove 14 of the head of upper casing 10, and therefore is assembled a portable electrical brush with a water supply means and a detergent supply device. This special structure therefore can eliminate a lot of complicated assembling procedures and make more convenient for the manufacturing and repair of this product.

The portable electrical brush invented herein can provide general brushing use and can be connected with external water source to supply water during washing, the outlet 152 of container 15 can be opened for detergent or liquid polisher supply by the use of handle 173, and valve means 52 can let water from water pipe 53 flow through water pipe 45 to the indentation of brush 60 to spray water to the surroundings of brush 60. Since the centrifugal force produced by the fast rotating brush 60 exists, the lower pressure at the place where the additive liquid outlet 152 and water inlet pipe 45 meet together is induced on the basis of Bernoulli's flow law when water is flowing out of brush 60 and the additive liquid is sucked out automatically and continuously so that the washing work can be quick and satisfied.

The inventor has made a sample successfully and shown that the efficiency can be improved significantly to save one half washing time at least.

Although the present invention has been described in detail by way of illustration and example for purposes of clarity of understanding, it will, of course, be understood that various changes and modifications may be made in the form, details, and arrangements of the parts without departing from the scope of the invention as set forth in the following claims.

I claim:

1. A portable electrically driven brush comprising:

a casing having upper and lower portions forming a hollow interior compartment;

a support plate mounted in said compartment;

motor means and speed reduction gear means mounted on said support plate, said motor means including switch means to control said motor means;

means coupling said motor means to said reduction gear means;

a hollow shaft mounted in said lower portion and having an upper end a lower end, said upper end coupled to said reduction gear means and said lower end extending outside of said lower portion;

a pipe means extending from within said casing into said hollow shaft;

a water supply means coupled to said casing and connected to said pipe means to discharge water through said hollow shaft, said water supply means having valve means to control the flow therethrough;

an additive container mounted on the upper casing portion, said container having means to discharge additive from said container to said pipe means to mix said additive with said water prior to discharge from said hollow shaft, said means to discharge including outlet means from the container and valve means to control said outlet means; and a brush mounted on the lower end of said hollow shaft, said brush having a central opening mounting said brush on said hollow shaft and providing means for passage of water and additive through said brush to a work surface.

2. The brush of claim 1 wherein a sealing O-ring is positioned between the wall of the lower portion of said casing and the exterior of said hollow shaft.

3. The brush of claim 1 wherein the lower end of said hollow shaft has an external hexagonal shape and a slot divides the end into two cantilevered portions, the lower edge of each of said cantilevered portions having an enlarged external rim portion, the brush opening being hexagonal shape and adapted to be mounted on said lower end with said enlarged rim portion detachably retaining said brush on said lower end portion.

4. The brush of claim 1 wherein a sealing washer is inseted between the upper and lower portions of said casing.

5. The brush of claim 1 wherein said additive is liquid additive.

6. The brush of claim 1 wherein said additive container is able to be detached from the upper poriton of said casing.

* * * * *